US010100500B2

(12) United States Patent
Dooley et al.

(10) Patent No.: US 10,100,500 B2
(45) Date of Patent: Oct. 16, 2018

(54) MANAGING A FLUID CONDITION IN A PIPE

(71) Applicant: ENT. SERVICES DEVELOPMENT CORPORATION LP, Houston, TX (US)

(72) Inventors: Kevin Dooley, Leixlip (IE); Richard Coull, Leixlip (IE); Pat J. Reilly, Leixlip (IE)

(73) Assignee: Ent. Services Development Corporation LP, Houston, TX (US)

( * ) Notice: Subject to any disclaimer, the term of this patent is extended or adjusted under 35 U.S.C. 154(b) by 26 days.

(21) Appl. No.: 15/305,045

(22) PCT Filed: May 28, 2014

(86) PCT No.: PCT/US2014/039753

§ 371 (c)(1),
(2) Date: Oct. 18, 2016

(87) PCT Pub. No.: WO2015/183258

PCT Pub. Date: Dec. 3, 2015

(65) Prior Publication Data

US 2017/0138023 A1 May 18, 2017

(51) Int. Cl.
*E03B 7/12* (2006.01)
*F25B 41/00* (2006.01)
(Continued)

(52) U.S. Cl.
CPC ..... *E03B 7/12* (2013.01); *E03B 7/14* (2013.01); *F25B 41/00* (2013.01); *F25B 49/00* (2013.01);
(Continued)

(58) Field of Classification Search
CPC ..... E03B 7/10; E03B 7/12; E03B 7/14; Y10T 137/1189; Y10T 137/1244;
(Continued)

(56) References Cited

U.S. PATENT DOCUMENTS 4,457,326 A * 7/1984 Donnelly ..... E03B 7/02 126/588
4,635,668 A * 1/1987 Netter ..... E03B 7/12 137/392
(Continued)

FOREIGN PATENT DOCUMENTS

GB 2432875 A 6/2007
JP 11-222884 A 8/1999
(Continued)

OTHER PUBLICATIONS

PCT Search Report/Written Opinion ~ Application No. PCT/US2014/039753 dated Feb. 25, 2015 ~ 14 pages.

*Primary Examiner* — Reinaldo Sanchez-Medina
*Assistant Examiner* — David Colon Morales
(74) *Attorney, Agent, or Firm* — Sheppard Mullin Richter & Hampton LLP

(57) ABSTRACT

According to an example, a system for managing a fluid condition in a pipe includes a controller to receive temperatures of the pipe detected by the temperature sensor over a period of time. The controller may determine, based upon the temperatures of the pipe over the period of time, a temperature profile of the pipe and may determine that the temperature profile of the pipe indicates that a freezing onset event has occurred. The freezing onset event may include a transition from a drop in temperature to an increase in temperature, in which the temperature during the transition is below a freezing point temperature of a fluid contained in the pipe. The controller may further trigger at least one of an
(Continued)

alarm and an activation of a first freezing prevention device in response to the determination that the freezing onset event has occurred.

15 Claims, 7 Drawing Sheets

(51) Int. Cl.
*F25B 49/00* (2006.01)
*E03B 7/14* (2006.01)

(52) U.S. Cl.
CPC ..... *H05K 999/99* (2013.01); *Y10T 137/1963* (2015.04)

(58) Field of Classification Search
CPC ..... Y10T 137/1298; Y10T 137/1353; Y10T 137/1842; Y10T 137/1939; Y10T 137/1963; Y10T 137/1887; Y10T 137/85978; Y10T 137/85986; Y10T 137/86027; Y10T 137/7737
See application file for complete search history.

(56) References Cited

U.S. PATENT DOCUMENTS 4,657,038 A * 4/1987 Lyons ..... E03B 7/12 137/62
4,664,143 A 5/1987 Thompson
4,672,990 A * 6/1987 Robillard ..... E03B 7/12 126/588
4,730,637 A * 3/1988 White ..... E03B 7/12 137/468
5,014,731 A 5/1991 Westerberg
5,056,554 A * 10/1991 White ..... E03B 7/12 137/312
5,220,937 A * 6/1993 Roberts ..... E03B 7/12 122/504
5,240,179 A * 8/1993 Drinkwater ..... E03B 7/12 137/59
5,402,815 A * 4/1995 Hoch, Jr. ..... E03B 7/10 137/312
5,692,535 A 12/1997 Walters
5,715,855 A 2/1998 Bennett
6,125,873 A 10/2000 Brown
6,196,246 B1 * 3/2001 Folsom ..... E03B 7/12 122/504
6,622,930 B2 * 9/2003 Laing ..... E03B 7/12 137/59
6,763,845 B2 * 7/2004 Hoggard ..... E03B 7/10 137/434
7,954,506 B2 * 6/2011 Swan ..... E03B 7/12 137/334
8,141,584 B1 * 3/2012 Ellyson ..... E03B 1/041 137/571
8,196,602 B2 * 6/2012 Korzeniowski ..... E03B 7/12 137/563
9,683,350 B1 * 6/2017 Mitzev ..... E03B 7/12
2003/0196694 A1 10/2003 Harvey
2010/0108152 A1 5/2010 Caleffi
2011/0114202 A1 * 5/2011 Goseco ..... E03B 7/04 137/487.5
2011/0233290 A1 * 9/2011 Borovinov ..... F24D 19/1015 236/93 R
2012/0097253 A1 4/2012 Eutsler
2013/0025709 A1 * 1/2013 Mann ..... E03B 7/10 137/468
2014/0000724 A1 * 1/2014 Park ..... E03B 7/08 137/78.1
2014/0238511 A1 * 8/2014 Klicpera ..... E03B 7/071 137/551
2014/0261693 A1 * 9/2014 Geerligs ..... E03B 7/12 137/1

FOREIGN PATENT DOCUMENTS

JP 2003-193522 A 7/2003
JP 2010-065508 A 3/2010
KR 10-1289929 B1 7/2013
KR 10-2014-0049759 A 4/2014

* cited by examiner

MANAGING A FLUID CONDITION IN A PIPE

CLAIM FOR PRIORITY

The present application is a national stage filing under 35 U.S.C. § 371 of PCT application number PCT/US2014/039753, having an international filing date of May 28, 2014, the disclosure of which is hereby incorporated by reference in its entirety.

BACKGROUND

When fluid in pipes, such as those in homes freeze due to environmental temperatures falling below a certain level, the pipes oftentimes burst when the fluid thaws. Damage caused by the burst pipes often cost homeowners thousands of dollars to repair. To prevent the freezing of fluid in pipes, homeowners often resort to various manual prevention techniques, such as turning off water mains, maintaining room temperatures above a certain temperature, keeping a faucet open to cause the fluid in the pipes to continuously flow, draining water from the piping system, heating the pipes, etc.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1:
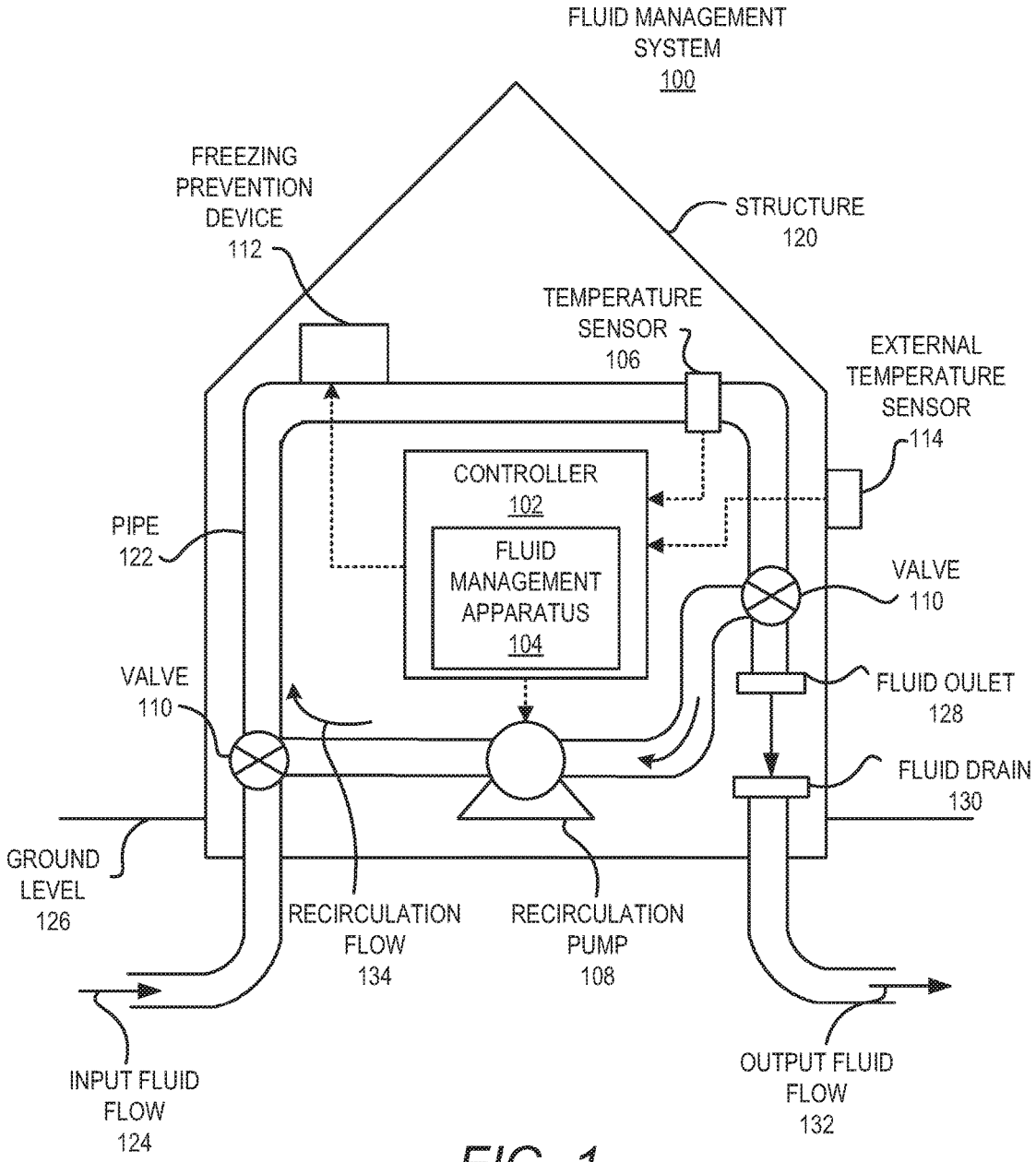
FIG. 1 is a simplified diagram of a fluid management system, which may implement various aspects of the methods disclosed herein, according to an example of the present disclosure.

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Disclosed herein are methods for managing a fluid condition in a pipe and apparatuses for implementing the methods. In the methods, temperatures of the pipe may be received from a temperature sensor over a period of time. In addition, based upon the received temperatures of the pipe over the period of time, a temperature profile of the pipe may be determined. Moreover, a determination may be made that the temperature profile of the pipe indicates that a freezing onset event has occurred. The freezing onset event may include a transition from a drop in temperature to an increase in temperature, in which the temperature during the transition is below a freezing point temperature of a fluid contained in the pipe. By way of example, the freezing onset event (or the latent heat of freezing event) may be identified as a change in enthalpy that occurs prior to a liquid freezing. For instance, the freezing onset event may be identified as an immediate increase in temperature following the drop in temperature. Moreover, at least one of an alarm and an activation of a first freezing prevention device may be triggered in response to the determination that the freezing onset event has occurred.

As discussed herein, the occurrence of the freezing onset event may be identified through an analysis of a temperature profile. More particularly, the temperature profile may indicate that the fluid in the pipe has a temperature that is below a freezing point temperature for that fluid and that the fluid has begun releasing heat, which may be an indication that the fluid is about to freeze. Thus, by identifying a freezing onset event in the temperature profile, a determination may be made as to whether freezing of a fluid in a pipe is likely imminent. In addition, if the fluid in the pipe is likely to freeze in the near future, a user may be notified via triggering of an alarm and/or activation of a freezing prevention device may be triggered.

According to an example, the determination of the freezing onset event and triggering of the alarm and/or activation of a freezing prevention device may occur following the activation of another freezing prevention device. That is, another freezing prevention device, such as a recirculation pump, may be automatically activated when an ambient or external temperature falls below a preset level. In this example, the freezing onset event consideration disclosed herein may be made to ensure that the activated freezing prevention device is operating properly. That is, in the event that the activated prevention device is not operating properly or has failed, the freezing onset event consideration disclosed herein may enable a relatively quick determination of such failure. As such, other measures, such as secondary heating elements, whole house heaters, etc., may also be activated quickly to compensate for the failed freezing prevention device and possibly prevent pipes from freezing.

Through implementation of the methods and apparatuses disclosed herein, a fluid condition in a pipe may automatically be managed, for instance, to prevent and/or delay freezing of the fluid in the pipe. In addition, following freezing of the fluid in the pipe, the methods and apparatuses disclosed herein may enable a determination to automatically be made that thawing is about to or is currently occurring and a user may be notified of the thawing. In one regard, the methods and apparatuses disclosed herein may reduce or eliminate the use of manual prevention techniques, which are known to waste water and/or energy.

With reference first to FIG. 1, there is shown a simplified diagram of a fluid management system 100, which may implement various aspects of the methods disclosed herein, according to an example. It should be understood that the fluid management system 100 depicted in FIG. 1 may include additional elements and that some of the elements depicted therein may be removed and/or modified without departing from a scope of the fluid management system 100.

As shown in FIG. 1, the fluid management system 100 may include a controller 102, which may contain a fluid management apparatus 104. The controller 102 may be a computing device, such as a personal computer, a laptop computer, a tablet computer, a smartphone, etc. In addition, or alternatively, the controller 102 may be a specialized computing device that is to perform the functions disclosed herein. The fluid management apparatus 104 is described in detail below.

The fluid management system 100 may also include a temperature sensor 106, a recirculation pump 108, valves 110, a freezing prevention device 112, and an external temperature sensor 114. In addition, the fluid management system 100 may be contained inside and/or located outside of a structure 120, in which the structure 120 may include pipes 122 that run through the structure 120. Particularly, for instance, the structure 120 is a house and the pipes 122 are water lines that run through the house. In any regard, input fluid flow 124 may be supplied into the pipes 122 from a source (not shown), in which the input fluid flow 124 is supplied through a portion of the pipe 122 that is positioned beneath ground level 126. That is, the portion of the pipe 122 from which the fluid is supplied into the pipes 122 may be positioned sufficiently beneath the ground level 126 to prevent the fluid from freezing when the outside temperature falls below 0° C.

Under temperature conditions that exceed 0° C., the fluid flowing through the pipes 122 is typically not subject to freezing. As such, under these conditions, fluid may be released from the pipes 122 through a fluid outlet 128, which may be a faucet, a showerhead, a toilet, etc., through actuation of a valve (not shown). In addition, waste fluid may be collected into a fluid drain 130 and discarded as output fluid flow 132, for instance, into a sewage system (not shown).

In various instances, portions of the pipe 122 run through an attic of the structure 120. As attics are typically uninsulated and allow external air to flow through portions of the attic, portions of the pipe 122 may thus be exposed to ambient or temperatures external to the structure 120. When ambient temperatures fall below the freezing point for the fluid contained in the pipe 122, the fluid may freeze. According to an example, and as discussed in greater detail herein, the controller 102, and particularly, the fluid management apparatus 104, may trigger at least one of an alarm and an activation of the freezing prevention device 112 when the controller 102 determines that a temperature profile of the pipe 122 indicates that a freezing onset event has occurred and that freezing of the fluid in the pipe 122 is likely to occur. When the freezing onset event has been determined to have occurred, freezing of the fluid in the pipe 122 may likely be imminent. For instance, the fluid may freeze in a few minutes, an hour, a couple of hours, etc., depending upon the ambient temperature. That is, freezing may occur more quickly when the ambient temperature is lower than when the ambient temperature is higher.

As shown in FIG. 1, the temperature sensor 106, which may include a thermometer, a thermocouple, etc., may detect the temperature of the pipe 122, for instance, that is in a section of the structure 120 that may be exposed to external ambient temperature conditions, such as an attic of a building. The temperature sensor 106 may continuously detect the temperature of the pipe 122 or may periodically detect the temperature of the pipe 122 at set intervals of time. In addition, the temperature sensor 106 may communicate the detected temperature measurements to the controller 102, either continuously or at set intervals of time. The temperature sensor 106 may communicate the detected temperature sensors through a wired or a wireless connection to the controller 102. Thus, for instance, the temperature sensor 106 may be wired to the controller 102 or may communicate wirelessly, e.g., via a Bluetooth connection, via a wireless fidelity (wifi) connection, a wireless local area network connection, etc.

In any regard, and as discussed in greater detail herein, the fluid management apparatus 104 may determine a temperature profile of the pipe 122 from the received temperatures and may analyze the temperature profile of the pipe 122 to determine whether a freezing onset event has occurred. The fluid management apparatus 104 may also trigger at least one of an alarm and an activation of a freezing prevention device 112 in response to the determination that the freezing onset event has occurred.

In one example, the recirculation pump 108 is to become activated to cause fluid to be recirculated through the pipe 122 as indicated by the arrow 134. That is, the valves 110 positioned along the pipe 122 may be arranged such that the fluid contained in the pipe 122 may be recirculated through the pipe 122 through application of pressure on the fluid by the recirculation pump 108. By way of particular example, the recirculation pump 108 may cause the fluid to flow through the pipe 122 at a relatively low flow rate, such as around 0.5 liters/minute. The flow rate at which the recirculation pump 108 may cause the fluid to flow through the pipe 122 may be based upon the actual or anticipated ambient temperatures of the structure 120. That is, the flow rate of the recirculation pump 108 may be selected such that the flow rate is sufficient to prevent or sufficiently delay the fluid contained in the pipe 122 from freezing.

The recirculation pump 108 may become activated, for instance, when the temperature either inside or outside of the structure 120 falls below a predetermined threshold temperature. The recirculation pump 108 may also become deactivated when the temperature either inside or outside of the structure 120 meets or exceeds the predetermined threshold temperature. The recirculation pump 108 may further become deactivated when the temperature exceeds the predetermined threshold temperature by a predefined amount. The predetermined threshold temperature inside of the structure 120 may differ from the predetermined threshold temperature outside of the structure 120. For instance, the predetermined threshold temperature outside of the structure 120 may be around 2° C. According to an example, the recirculation pump 108 is to become activated automatically, i.e., without input from the controller 102. In another example, the controller 102 is to activate the recirculation pump 108 when the controller 102 determines that the temperature has fallen below the predetermined threshold temperature.

In any regard, the fluid management apparatus 104 may trigger activation of the freezing prevention device 112 following activation of the recirculation pump 108 in response to a temperature profile of the pipe 122 indicating that freezing of the fluid in the pipe 122 is likely imminent. In one regard, therefore, the fluid management apparatus 104 may operate as a failsafe or backup to the recirculation pump 108. By way of particular example, the recirculation pump 108 may be deemed to have failed if the temperature profile includes a transition from a drop in temperature to an increase in temperature, in which the temperature during the transition is below a freezing point temperature of the fluid contained in the pipe 122, e.g., the temperature during the transition is below a temperature at which the fluid freezes. In one regard, if the recirculation pump 108 is operating properly, the temperature profile of the pipe 122 should not include the freezing onset event discussed herein.

The freezing prevention device 112 may be, for instance, any suitable device that may heat the fluid contained in the pipe 122. By way of example, the freezing prevention device 112 is a heating coil that is in contact with the pipe 122, a heating device that is to direct heat onto the pipe 122, a home heater, or etc. In addition, although a single freezing prevention device 112 has been depicted in FIG. 1, it should be understood that the fluid management system 100 may include any number of freezing prevention devices that may be activated individually, sequentially, or together, without departing from a scope of the fluid management system 100 disclosed herein.

In another example, the recirculation pump 108 may itself be construed as a freezing prevention device 112. In this example, the fluid management apparatus 104 may trigger activation of the recirculation pump 108 in response to a temperature profile of the pipe 122 indicating that the fluid in the pipe 122 is likely to freeze, e.g., that a freezing onset event has occurred. That is, instead of activating the recirculation pump 108 when the temperature, e.g., the ambient temperature outside of the structure 120, falls below a predetermined threshold temperature, the fluid management apparatus 104 may activate the recirculation pump 108 when a temperature profile of the pipe 122 indicates that a freezing onset event has occurred.

Figure 2:
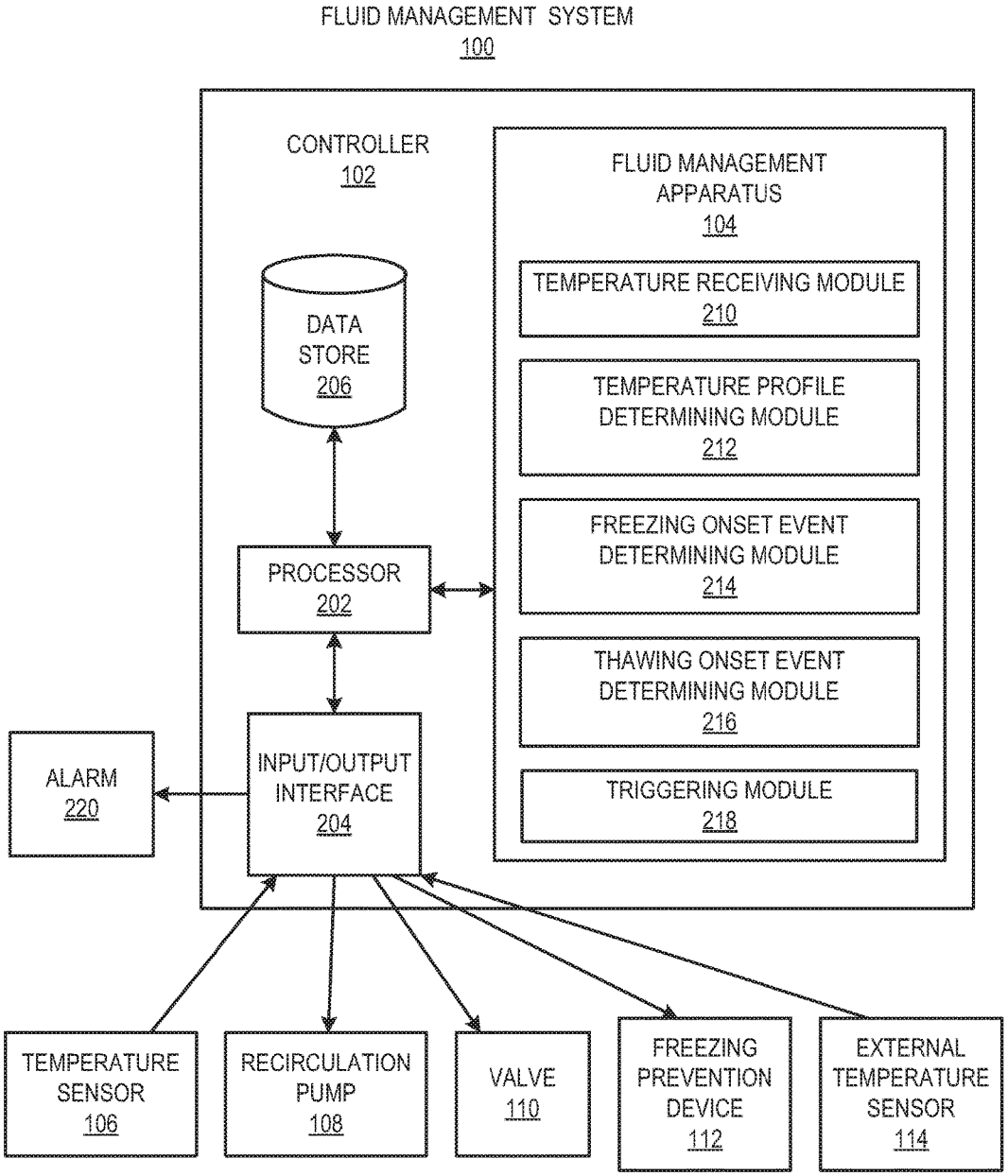
FIG. 2 is a simplified block diagram of the fluid management system shown in FIG. 1, according to an example of the present disclosure.

Turning now to FIG. 2, there is shown a simplified block diagram of the fluid management system 100, according to an example. It should be understood that the fluid management system 100 depicted in FIG. 2 may include additional elements and that some of the elements depicted therein may be removed and/or modified without departing from a scope of the fluid management system 100.

As shown in FIG. 2, the fluid management system 100 is depicted as including, in addition to the controller 102 and the fluid management apparatus 104, a processor 202, an input/output interface 204, and a data store 206. The fluid management apparatus 104 is also depicted as including a temperature receiving module 210, a temperature profile determining module 212, a freezing onset event determining module 214, a thawing onset event determining module 216, and a triggering module 218.

The processor 202, which may be a microprocessor, a micro-controller, an application specific integrated circuit (ASIC), or the like, is to perform various processing functions in the controller 102. The processing functions may include invoking or implementing the fluid management apparatus 104 and particularly, the modules 210-218 of the fluid management apparatus 104, as discussed in greater detail herein below. According to an example, the fluid management apparatus 104 is a hardware device on which is stored various sets of machine readable instructions. The fluid management apparatus 104 may be, for instance, a volatile or non-volatile memory, such as dynamic random access memory (DRAM), electrically erasable programmable read-only memory (EEPROM), magnetoresistive random access memory (MRAM), memristor, flash memory, floppy disk, a compact disc read only memory (CD-ROM), a digital video disc read only memory (DVD-ROM), or other optical or magnetic media, and the like, on which software may be stored. In this example, the modules 210-218 may be software modules, e.g., sets of machine readable instructions, stored in the fluid management apparatus 104.

In another example, the fluid management apparatus 104 may be a hardware component, such as a chip, and the modules 210-218 may be hardware modules on the hardware component. In a further example, the modules 210-218 may include a combination of software and hardware modules. In a yet further example, the processor 202 may be an ASIC that is to perform the functions of the modules 210-218. In this example, the processor 202 and the fluid management apparatus 104 may be a single processing apparatus.

The processor 202 may store data in the data store 206 and may use the data in implementing the modules 210-218. For instance, the processor 202 may store data pertaining to the temperature measurements received from the temperature sensor 106, and in some examples, the external temperature sensor 114. In any regard, the data store 206 may be volatile and/or non-volatile memory, such as DRAM, EEPROM, MRAM, phase change RAM (PCRAM), memristor, flash memory, and the like. In addition, or alternatively, the data store 206 may be a device that may read from and write to a removable media, such as, a floppy disk, a CD-ROM, a DVD-ROM, or other optical or magnetic media.

The input/output interface 204 may include hardware and/or software to enable the processor 202 to communicate with various elements of the fluid management system 100 external to the controller 102. Thus, for instance, the input/output interface 204 may include hardware and/or software to enable the processor 202 to communicate with those various elements over a network, such as a local area network. In this regard, the input/output interface 204 may enable communication through implementation of various wifi and/or Bluetooth protocols. The input/output interface may also include a network interface card and/or may also include hardware and/or software to enable the processor 202 to communicate with various input and/or output devices (not shown), such as a keyboard, a mouse, a display, another computing device, etc., through which a user may input instructions into the controller 102.

Although the controller 102 is depicted as communicating with each of the temperature sensor 106, the recirculation pump 108, the valve 110, the freezing prevention device 112, the external temperature sensor 114, and an alarm 220, it should be clearly understood that the controller 102 may communicate with a subset of these elements without departing from a scope of the fluid management system 100.

Figure 3:
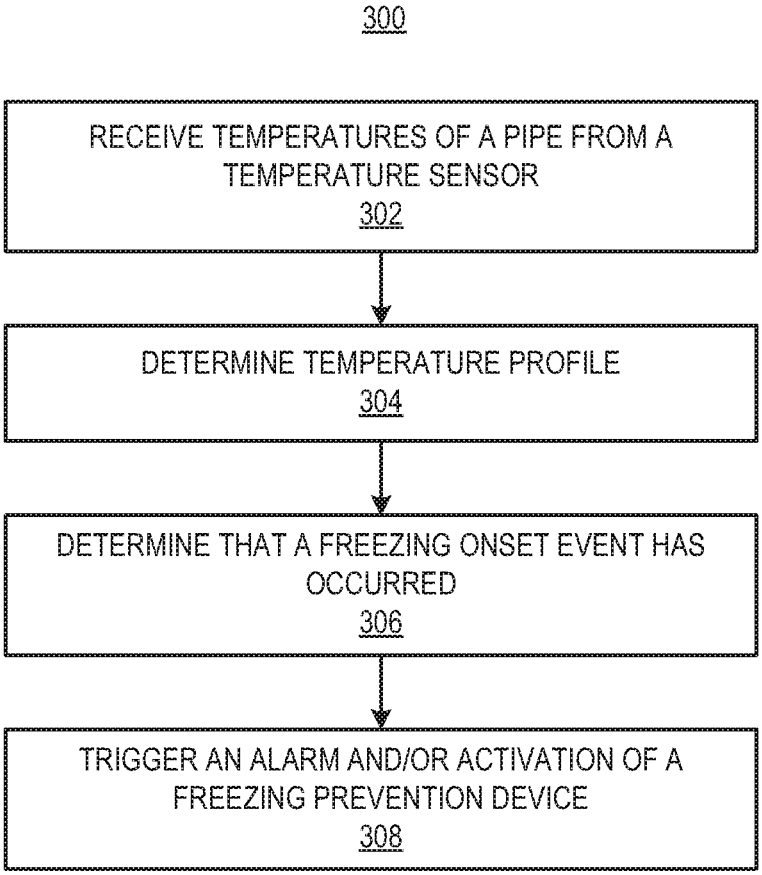
FIGS. 3 and 4, respectively, are flow diagrams of methods for managing a fluid condition in a pipe, according to examples of the present disclosure.
Figure 4:
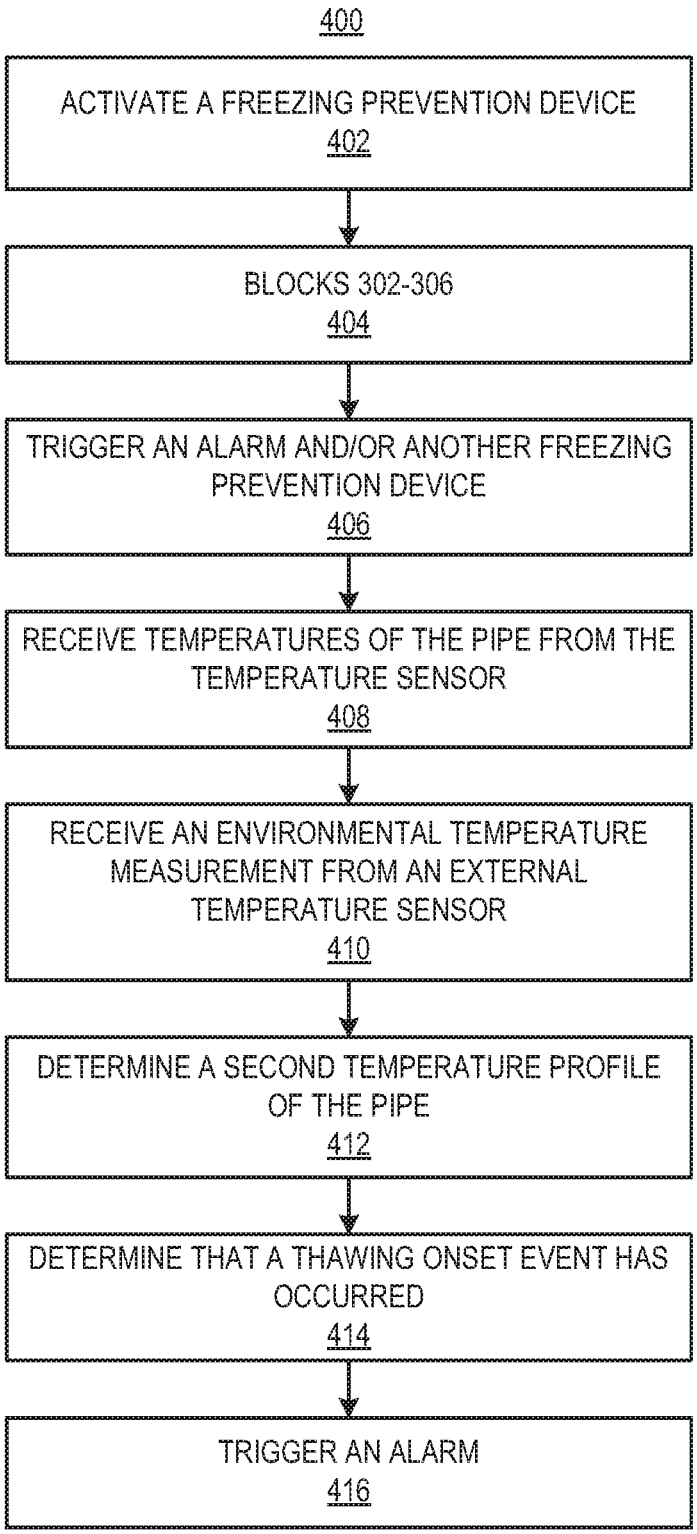

Various manners in which the processor 202 in general, and the modules 210-218 in particular, may be implemented are discussed in greater detail with respect to the methods 300 and 400 respectively depicted in FIGS. 3 and 4. Particularly, FIGS. 3 and 4, respectively, depict flow diagrams of methods 300 and 400 for managing a fluid condition in a pipe 122, according to various examples. It should be apparent to those of ordinary skill in the art that the methods 300 and 400 may represent generalized illustrations and that other operations may be added or existing operations may be removed, modified, or rearranged without departing from the scopes of the methods 300 and 400. Generally speaking, the processor 202 depicted in FIG. 2 may implement any of methods 300 and 400 through implementation of at least some of the modules 210-218. In addition, the method 400 generally includes features that are more specific examples of the features contained in the method 300.

The descriptions of the methods 300 and 400 are made with reference to the fluid management system 100 illustrated in FIGS. 1 and 2 for purposes of illustration. It should, however, be clearly understood that fluid management systems having other configurations may be implemented to perform any of the methods 300 and 400 without departing from the scopes of the methods 300 and 400.

With reference first to the method 300 depicted in FIG. 3, at block 302, temperatures of the pipe 122 detected by a temperature sensor 106 may be received over a period of time. For instance, the temperature sensor 106 may detect the temperature of the pipe 122 in a substantially continuous basis or at predetermined intervals of time over a period of time, e.g., over an hour, over a day, over a few days, etc. In addition, the temperature sensor 106 may communicate the detected temperatures to the controller 102. Moreover, the temperature receiving module 210 may receive the temperatures of the pipe 122 as detected by the temperature sensor 106 over the period of time. The temperature receiving module 210 may also store the received temperatures in the data store 206.

Figure 5:
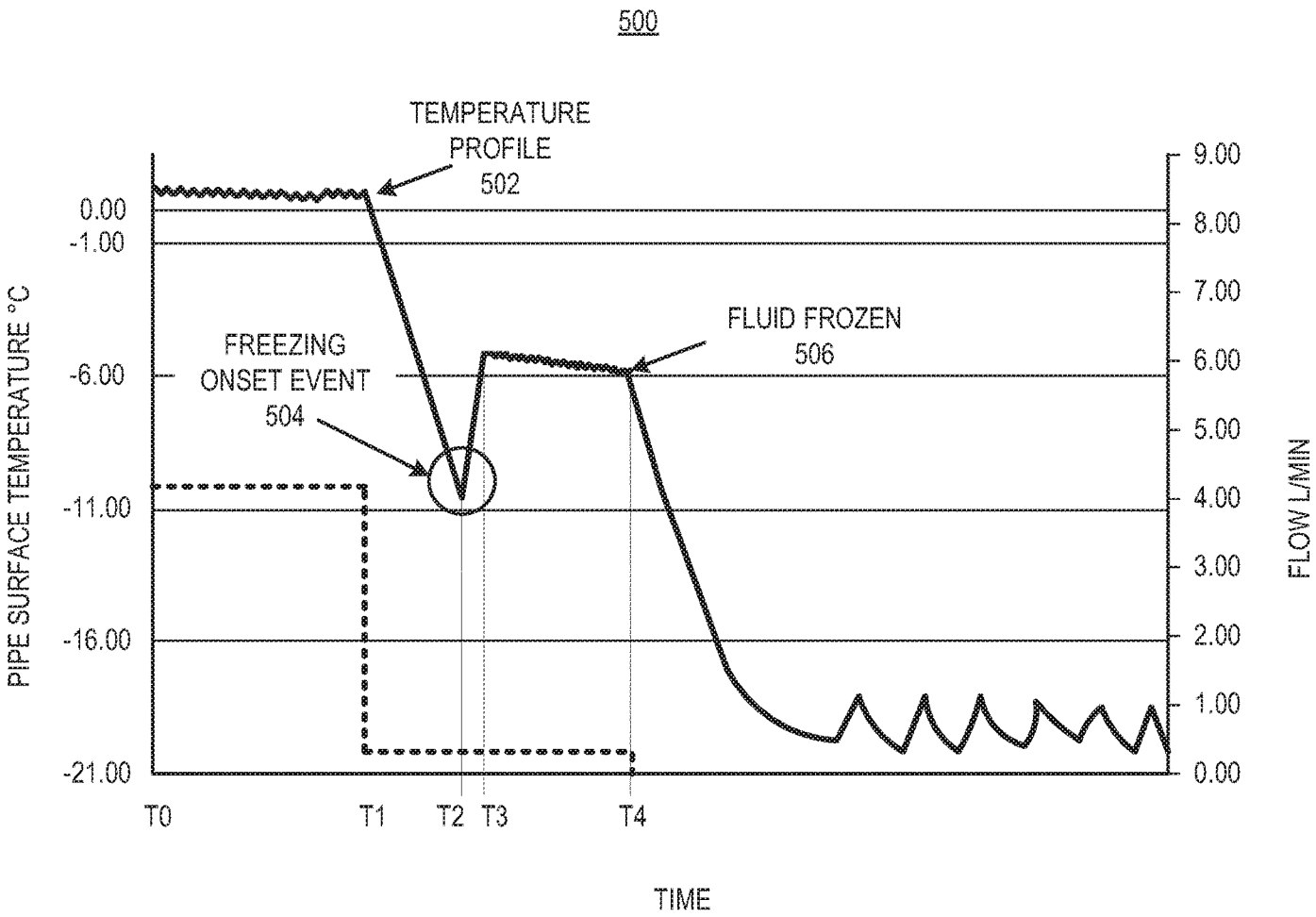
FIGS. 5 and 6, respectively, are diagrams of temperature profiles, according to examples of the present disclosure.

At block 304, a temperature profile of the pipe 122 may be determined based upon the received temperatures of the pipe 122 over the period of time. For instance, the temperature profile determining module 212 may determine the temperature profile of the pipe 122 over the period of time. According to an example, the temperature profile of the pipe 122 may be a profile of the temperature of the pipe 122 over time. An example of a temperature profile 502 is depicted in FIG. 5. It should be clearly understood that the temperature profile 502 depicted in FIG. 5 is purely an illustration and should not be construed as limiting the scope of the fluid management system 100 or methods disclosed herein in any manner.

As shown in FIG. 5, the temperature profile 502 of the pipe 122 generally tracks the change in temperature of the pipe 122, for instance, as detected by the temperature sensor 106, over time. The temperature profile 502 also depicts how the temperature of the pipe 122 changes as the flow of the fluid in the pipe 122 changes. The flow of fluid is denoted by the dashed line. For instance, the temperature of the pipe 122 may remain above 0° C. when the fluid remains flowing through the pipe 122, even as the temperature outside of the pipe 122 falls to below −16.00° C. For instance, the fluid recirculation pump 108 may cause the fluid to flow through the pipe 122. However, if the fluid flow stops or goes below a sufficiently low level, as indicated at time T1, the temperature of the pipe 122, and thus the fluid contained in the pipe 122, may fall at a relatively rapid pace. In addition, prior to becoming frozen 506, the temperature of the pipe 122 may actually rise for a time as indicated at time T2 and may plateau as indicated at time T3 prior to freezing as indicated at time T4. The rise in temperature following time T2 may occur because fluids typically release heat before and/or during the onset of freezing. The drop in temperature occurring between time T1 and time T2 followed by the rise in temperature occurring immediately following time T2, but prior to time T3, may be construed as a freezing onset event 504. Thus, for instance, a freezing onset event may be determined to have occurred immediately following the rise in temperature at time T2.

With reference back to FIG. 3, at block 306, a determination may be made that a freezing onset event has occurred, and thus, that freezing of the fluid in the pipe 122 is likely imminent. The amount of time between occurrence of the freezing onset event and the complete freezing of the fluid may be determined through testing of the fluid at different external temperatures and may vary for different external temperatures. In addition, the freezing onset event determining module 214 may determine that the freezing onset event has occurred. For instance, the freezing onset event determining module 214 may analyze the temperature profile 502 to determine whether there is a transition from a drop in temperature of the pipe 122 to an increase in temperature, while the temperature at the transition is below a freezing point temperature (e.g., 0° C.) of the fluid. According to an example, the freezing onset event determining module 214 may determine whether the temperature profile 502 indicates that a decrease in temperature that exceeds a predetermined rate of temperature drop is followed by an increase in temperature that exceeds a predetermined rate of temperature increase. The predetermined rate of temperature drop and the predetermined rate of temperature increase may be determined through testing of the fluid at different external temperatures to determine which rates result in freezing of the fluid within a predetermined length of time. In another example, the freezing onset event determining module 214 may determine whether the temperature profile 502 indicates that the temperature has decreased below the freezing point temperature of the fluid and has subsequently increased. In any of the examples above, the freezing onset event determining module 214 may determine that the freezing onset event has occurred immediately following a determination that the transition from the drop in temperature has been followed by the increase in temperature.

According to an example, the controller 102 may also receive an environmental temperature measurement from the external temperature sensor 114. In this example, the freezing onset event determining module 214 may include the received environmental temperature measurement in determining whether the temperature profile of the pipe indicates that a freezing onset event has occurred. That is, depending upon the environmental temperature, a particular temperature profile may or may not indicate that a freezing has occurred. The determination as to which temperatures result in which temperature profiles indicating these properties may be determined through testing. In another regard, the environmental temperature measurement may be used to more easily identify the inflection point (time T2 in the temperature profile 502).

At block 308, an alarm and/or activation of a freezing prevention device 112 may be triggered in response to the determination that the freezing onset event has occurred. For instance, the triggering module 218 may trigger an alarm 220, which may include any type of notification to a user that freezing in the pipe 122 is likely to occur based upon the determination that the freezing onset event has occurred. The alarm 220 may include, for instance, an audible device, a visual device, an indication on a telephone, etc. In addition, or alternatively, the triggering module 218 may trigger activation of a first freezing prevention device 112. Thus, for instance, the triggering module 218 may communicate an instruction signal to a first freezing prevention device 112 to become activated.

Turning now to FIG. 4, at block 402, a freezing prevention device 108/112 may be activated. According to an example, the freezing prevention device 108/112 may be activated automatically, e.g., when the freezing prevention device 108/112 determines or receives an indication that the external temperature has fallen below a preset temperature level, e.g., 2° C. In another example, the fluid management apparatus 104 may control the freezing prevention device to become activated when the external temperature has fallen below the preset temperature level.

As indicated at block 404, blocks 302-306 may be implemented to determine that a freezing onset event has occurred on the pipe 122. In addition, at block 406, an alarm and/or activation of another freezing prevention device 112 may be triggered. The alarm and/or activation of the another freezing prevention device 112 may be triggered in any of the manners discussed above with respect to block 308 in FIG.

3. In one regard, therefore, at block 402, a freezing prevention device, such as the recirculation pump 108 or another freezing prevention device 112, may be automatically activated when the exterior temperature falls below a preset level. In addition, at block 406, another freezing prevention device 112, such as a heater, IR lamp, etc., may be activated when the temperature profile of the pipe 122 indicates that a freezing onset event has occurred. Thus, for instance, blocks 404 and 406 may be implemented as a backup or a failsafe for the freezing prevention device 108/112 activated at block 402.

For example, the temperature profile 502 depicted in FIG. 5, and particularly, between times T1 and T3, may occur when there is a sudden failure in the freezing prevention device 108/112 that was activated at block 402. That is, activation of the freezing prevention device 108/112 may cause the temperature of the pipe 122 to remain fairly constant and above freezing as denoted between times T0 and T1. However, when the freezing prevention device 108/112 fails, a sudden drop in temperature may be detected. As such, the sudden drop in temperature may be identified as a failure in the freezing prevention device 108/112 and thus, the fluid management apparatus 104 may trigger another freezing prevention device 112 to become activated.

According to an example, the freezing prevention device activated at block 402 is the recirculation pump 108 and the other freezing prevention device activated at block 406 is a heating element. The recirculation pump 108 may be activated prior to the heating element because the recirculation pump 108 may consume less energy than the heating element. In this regard, the recirculation pump 108 may be activated more frequently than the heating element to thus minimize the amount of energy required to prevent freezing in the pipes 122.

At block 408, temperatures of the pipe 122 may be received from the temperature sensor 106 over a period of time. Block 408 may be similar to block 302, but may be implemented following a freezing of the fluid in the pipe 122.

At block 410, an environmental temperature measurement may be received from the external temperature sensor 114. For instance, the temperature receiving module 210 may receive the environmental temperature measurement from the external temperature sensor 114 in any of the manners discussed above with respect to the receipt of the temperature measurements from the temperature sensor 106.

Figure 6:
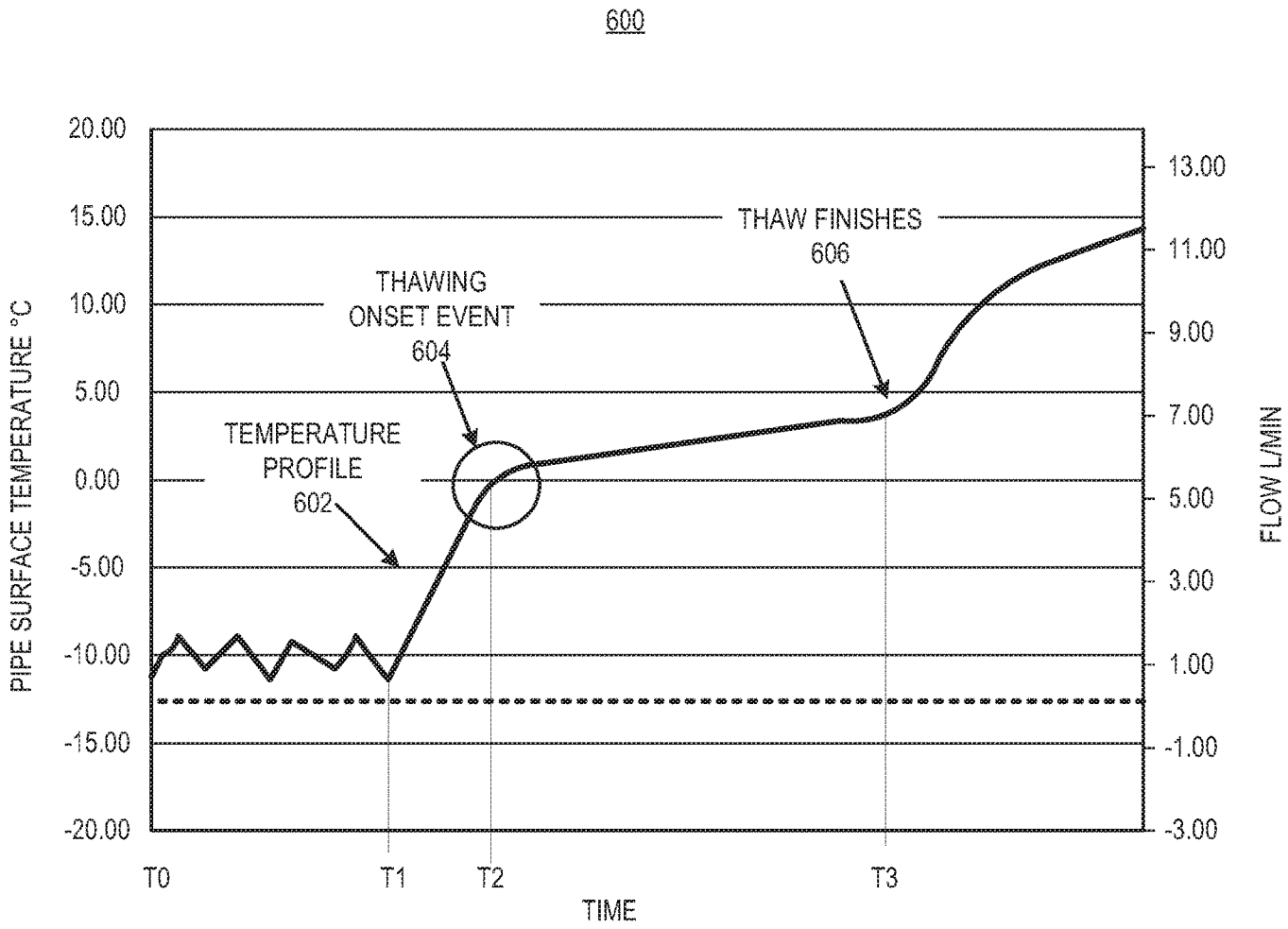

At block 412, a second temperature profile of the pipe 122 may be determined based upon the received temperatures of the pipe 122 over a period of time. For instance, the temperature profile determining module 212 may determine the second temperature profile of the pipe 122 over a period of time that is later than the period of time at block 302. According to an example, the temperature profile of the pipe 122 may be a profile of the temperature of the pipe 122 over time after the fluid in the pipe 122 has frozen. An example of a second temperature profile 602 is depicted in FIG. 6. It should be clearly understood that the temperature profile 602 depicted in FIG. 6 is purely an illustration and should not be construed as limiting the scope of the fluid management system 100 or methods disclosed herein in any manner.

As shown in FIG. 6, the second temperature profile 602 of the pipe 122 generally tracks the change in temperature of the pipe 122, for instance, as detected by the temperature sensor 106, over time. The second temperature profile 602 also depicts how the temperature of the pipe 122 and the flow of the fluid in the pipe 122 change as the external temperature increases over time. The flow of fluid is denoted by the dashed line and remains near zero l/min while the fluid remains frozen. As the frozen fluid begins to thaw, FIG. 6 shows that the second temperature profile 602 includes a particular shape. For instance, as the external temperature increases, the pipe 122 experiences a relatively sharp increase in temperature, as noted by the section of the profile 602 between times T1 and T2. In addition, following time T2, the profile 602 includes a section that has a relatively shallower slope as compared to the section between times T1 and T2. Moreover, thawing of the fluid does not finish 606 until time T3.

With reference back to FIG. 4, at block 414, a determination may be made that a thawing onset event has occurred based upon an analysis of the second temperature profile 602. For instance, the thawing onset event determining module 216 may determine that thawing is likely imminent in response to the second temperature profile 602 containing an indication that a rate of change in the temperature of the pipe changes from a first rate to a second rate, wherein the second rate is lower than the first rate. The length of time between when the thawing onset event and thawing occurs may be determined through testing. In addition, the determination at block 414 may be made while also considering the environmental temperature. For instance, different environmental temperatures may result in different determinations as to when thawing is likely to occur following a determination that a thawing onset event has occurred. In another regard, the environmental temperature measurement may be used to more easily identify the inflection point (time T2 in the temperature profile 602).

At block 416, an alarm indicating that thawing is likely imminent may be triggered. For instance, the triggering module 218 may trigger an alarm 220, which may include any type of notification to a user that thawing in the pipe 122 is likely imminent. As such, a user may be notified of an impending thawing of a frozen pipe or frozen fluid in the pipe so that the user may monitor the pipe and act quickly if the pipe bursts.

Some or all of the operations set forth in the methods 300 and 400 may be contained as utilities, programs, or subprograms, in any desired computer accessible medium. In addition, the methods 300 and 400 may be embodied by computer programs, which may exist in a variety of forms both active and inactive. For example, they may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Figure 7:
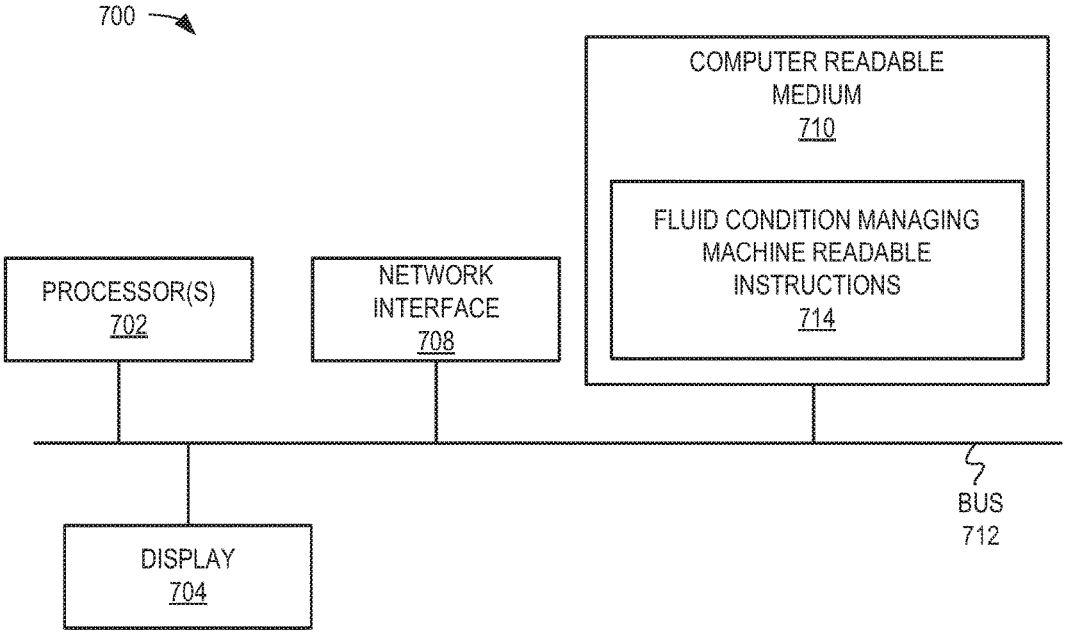
FIG. 7 is schematic representation of a computing device, which may be employed to perform various functions of the controller depicted in FIGS. 1 and 2, according to an example of the present disclosure.

Turning now to FIG. 7, there is shown a schematic representation of a computing device 700, which may be employed to perform various functions of the controller 102 depicted in FIGS. 1 and 2, according to an example. The computing device 700 may include a processor 702, a display 704, such as a monitor; a network interface 708, such as a Local Area Network LAN, a wireless 802.11x LAN, a 3G mobile WAN or a WiMax WAN; and a computer-readable medium 710. Each of these components may be operatively coupled to a bus 712. For example, the bus 712 may be an EISA, a PCI, a USB, a FireWire, a NuBus, or a PDS.

The computer readable medium 710 may be any suitable medium that participates in providing instructions to the processor 702 for execution. For example, the computer readable medium 710 may be non-volatile media, such as an optical or a magnetic disk; volatile media, such as memory. The computer-readable medium 710 may also store fluid condition managing machine readable instructions 714, which may perform some or all of the methods 300 and 400 and may include the modules 210-218 of the fluid management apparatus 104 depicted in FIGS. 1 and 2. In this regard, the fluid condition managing machine readable instructions 714 may include a temperature receiving module 210, a temperature profile determining module 212, a freezing onset event determining module 214, a thawing onset event determining module 216, and a triggering module 218.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A system for managing a fluid condition in a pipe, said system comprising:

a controller configured to receive temperatures of the pipe detected by a temperature sensor over a period of time, wherein the controller is further configured to:

determine, based upon the temperatures of the pipe over the period of time, a temperature profile of the pipe;

determine that the temperature profile of the pipe indicates that a freezing onset event has occurred, the freezing onset event including a transition from a drop in temperature to an increase in temperature, wherein the temperature during the transition is below a freezing point temperature of a fluid contained in the pipe; and trigger at least one of an alarm and an activation of a first freezing prevention device in response to the determination that the freezing onset event has occurred.

2. The system according to claim 1, further comprising:

the temperature sensor to detect the temperature of the pipe; and a second freezing prevention device, wherein the second freezing prevention device is to be activated in response to the temperature of the pipe falling below a predetermined temperature level and prior to the triggering of the at least one of the alarm and the activation of the first freezing prevention device.

3. The system according to claim 2, wherein the second freezing prevention device is a recirculation pump configured to cause the fluid in the pipe to be recirculated, and wherein the controller is further configured to control activation of the recirculation pump.

4. The system according to claim 1, wherein the first freezing prevention device comprises at least one of a recirculation pump configured to cause the fluid to be recirculated through the pipe and a heating device to heat the pipe.

5. The system according to claim 1, wherein to determine that the temperature profile of the pipe indicates that the freezing onset event has occurred, the controller is further configured to determine that the drop in temperature occurred from a temperature that is above the freezing point temperature of the fluid.

6. The system according to claim 1, wherein to determine that the temperature profile of the pipe indicates that the freezing onset event has occurred, the controller is further configured to determine that the increase in temperature occurred immediately following the decrease in temperature.

7. The system according to claim 1, wherein the pipe is housed in a structure, wherein the controller is further configured to receive an environmental temperature measurement from an external temperature sensor that is positioned outside of the structure to determine the environmental temperature and to include the received environmental temperature measurement in determining that the temperature profile of the pipe indicates that the freezing onset event has occurred.

8. The system according to claim 1, wherein the controller is further configured to determine that the temperature profile of the pipe indicates that a thawing onset event of a frozen fluid in the pipe has occurred, said thawing onset event including a first rise in temperature that exceeds a first predetermined rate of temperature rise followed by a second rise in temperature that falls below a second predetermined rate of temperature rise.

9. A method for managing a fluid condition in a pipe, said method comprising:

receiving temperatures of the pipe from a temperature sensor over a period of time;

determining, by a processor, based upon the received temperatures of the pipe over the period of time, a temperature profile of the pipe;

determining, by the processor, that the temperature profile of the pipe indicates that a freezing onset event has occurred, wherein the freezing onset event includes a transition from a drop in temperature to an increase in temperature, wherein the temperature during the transition is below a freezing point temperature of a fluid contained in the pipe; and triggering at least one of an alarm and an activation of a first freezing prevention device in response to the determination that the freezing onset event has occurred.

10. The method according to claim 9, wherein the triggering further comprises triggering the at least one of the alarm and the activation of the first freezing prevention device following activation of a second freezing prevention device, wherein the second freezing prevention device is to be activated in response to the temperature of the pipe falling below a predetermined temperature level.

11. The method according to claim 9, wherein the determining that the temperature profile of the pipe indicates that the freezing onset event has occurred further comprises determining that the drop in temperature occurred from a temperature that is above the freezing point temperature of the fluid.

12. The method according to claim 9, wherein the pipe is housed inside of a structure, said method further comprising:

receiving an environmental temperature measurement from an external temperature sensor that is positioned outside of the structure; and wherein the determining that the temperature profile of the pipe indicates that the freezing onset event has occurred further comprises including the received environmental temperature measurement in determining that the temperature profile of the pipe indicates that the freezing onset event has occurred.

13. The method according to claim 9, wherein the pipe is housed inside of a structure and wherein at least some of the fluid inside the pipe is frozen, said method further comprising:

receiving temperatures of the pipe from the temperature sensor over a second period of time;

determining a second temperature profile of the pipe based upon the received temperature of the pipe;

determining that a thawing onset event has occurred, said thawing onset event including a first rise in temperature that exceeds a first predetermined rate of temperature rise followed by a second rise in temperature that falls below a second predetermined rate of temperature rise.

14. A non-transitory computer readable storage medium on which is stored machine readable instructions that when executed by a processor cause the processor to:

receive temperatures of a pipe from a temperature sensor over a period of time;

determine, based upon the received temperatures of the pipe over the period of time, a temperature profile of the pipe;

determine that the temperature profile of the pipe indicates that a freezing onset event has occurred, wherein the freezing onset event includes a transition from a drop in temperature to an increase in temperature, wherein the temperature during the transition is below a freezing point temperature of a fluid contained in the pipe; and trigger at least one of an alarm and an activation of a first freezing prevention device in response to the determination that the freezing onset event has occurred.

15. The non-transitory computer readable storage medium according to claim 14, wherein the machine readable instructions are further configured to cause the processor to trigger the at least one of the alarm and the activation of the first freezing prevention device following activation of a second freezing prevention device, wherein the second freezing prevention device is to be activated in response to the temperature of the pipe falling below a predetermined temperature level.

* * * * *